US007571512B2

(12) United States Patent
Park et al.

(10) Patent No.: US 7,571,512 B2
(45) Date of Patent: Aug. 11, 2009

(54) VACUUM CLEANER

(75) Inventors: Tae Jin Park, Gimhae-si (KR); Sang Jun Park, Changwon-si (KR); Kang Won Moon, Changwon-si (KR); Seog Yong Kim, Changwon-si (KR); Suck Hyun Moon, Masan-si (KR)

(73) Assignee: LG Electronics Inc., Seoul (KR)

( * ) Notice: Subject to any disclaimer, the term of this patent is extended or adjusted under 35 U.S.C. 154(b) by 693 days.

(21) Appl. No.: 11/000,908

(22) Filed: Dec. 2, 2004

(65) Prior Publication Data

US 2005/0138760 A1 Jun. 30, 2005

(30) Foreign Application Priority Data

Dec. 27, 2003 (KR) ..... 10-2003-0098395

(51) Int. Cl.
*A47L 9/10* (2006.01)
*A47L 9/20* (2006.01)

(52) U.S. Cl. ..... 15/352; 15/327.7; 15/353

(58) Field of Classification Search ..... 15/327.7, 15/352, 253, 353
See application file for complete search history.

(56) References Cited

U.S. PATENT DOCUMENTS

| | | | | |
|---|---|---|---|---|
| 5,659,922 | A * | 8/1997 | Louis | 15/350 |
| 6,536,072 | B2 * | 3/2003 | Thur et al. | 15/323 |
| 6,818,032 | B2 * | 11/2004 | Bilek et al. | 55/337 |
| 7,247,182 | B2 * | 7/2007 | Boyer et al. | 55/429 |

* cited by examiner

*Primary Examiner*—Joseph J Hail, III
*Assistant Examiner*—Shantese L McDonald
(74) *Attorney, Agent, or Firm*—KED & Associates LLP

(57) ABSTRACT

Disclosed is a vacuum cleaner including a head having an inlet for sucking in polluted air with impurities from outside by an operation of an air suction device generating air suction force; a dust collector for collecting impurities contained in the polluted air; a main body having a dust collector receiving recess to which the dust collector is detachably provided; and a fixing device fixing the dust collector on the main body and releasing the dust collector when the dust collector is separated, wherein the fixing device including a switch provided at the main body and controlling the fixing state of the dust collector; and an elastic member incorporated integrally into the switch and restoring the switch to a fixing location of the dust collector.

19 Claims, 6 Drawing Sheets

VACUUM CLEANER

CROSS-REFERENCE TO RELATED APPLICATIONS

This application claims the benefit of Korean Application No. P2003-98395, filed on Dec. 27, 2003, which is hereby incorporated by reference as if fully set forth herein.

BACKGROUND OF THE INVENTION

1. Field of the Invention

The present invention relates to a vacuum cleaner, and more particularly, to a vacuum cleaner with a detachable dust collector.

2. Discussion of the Related Art

In general, as an apparatus for cleaning a floor or carpet of an interior, a vacuum cleaner sucks in polluted outside air with impurities through operation of an air suction device such as a motor provided in a main boy thereof, and collects impurities separated from polluted air, and discharges cleaned air to an outside thereof.

Hereinafter, a related art upright type vacuum cleaner will be described referring to FIG. 1. Referring to FIG. 1, the related art vacuum cleaner includes a head 2 moving on a floor and sucking polluted air with impurities, a main body 4 provided at an upper part of the head 2 and having an air suction device therein for generating air sucking force, and a cleaner handle 6 coupled with an upper part of the main body 4.

The heads 2, through an inlet provided on a bottom surface thereof, sucks in polluted air with impurities by operating the air suction device while moving on the floor to be cleaned.

As aforementioned, the main body 4 includes the air suction device (not shown) generating sucking force, and sucks in polluted air with impurities through the inlet by operating the air suction device.

The main body 4 is hinge coupled with an upper rear part of the head 2, and the body 4 is provided to be inclined rearward from the head 2 at a predetermined angle.

A cleaner handle 6 for a user to operate the movement of the vacuum cleaner is coupled to the upper part of the main body 4, thereby allowing the user to clean a desired area adjusting an inclination angle of the main body 4.

Meanwhile, on a front surface of the main body 4, a dust collector 8 is detachably provided for collecting impurities separated from the polluted air, and a fixing device is provided at the main body, particularly at an upper part of the dust collector, for detaching the dust collector.

In the related art upright vacuum cleaner configured as aforementioned, when a predetermined time is passed and the dust collector is filled with impurities, a user needs to empty the dust collector regularly.

The dust collector 8 needs to be separated from the main body 4 by manipulating the fixing device 7 for empting the dust collector 8. However, when the structure of the fixing device provided in the related art vacuum cleaner is complicated, or when a plurality of fixing devices is provided, because assembling the vacuum cleaner is complicated, problems that the productivity is lowered and expense is increased. Therefore, development of a fixing device with a simple structure and configured with one unit is demanded.

SUMMARY OF THE INVENTION

Accordingly, the present invention is directed to a vacuum cleaner that substantially obviates one or more problems due to limitations and disadvantages of the related art.

An object of the present invention is to provide a vacuum cleaner having a dust collector detachably provided.

Another object of the present invention is to provide a vacuum cleaner with a simple structure such that a process of assembling the vacuum cleaner is simplified and the production cost needed for producing the vacuum cleaner is reduced.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a vacuum cleaner includes a head having an inlet for sucking in polluted air with impurities from outside by an operation of an air suction device generating air suction force; a dust collector for collecting impurities contained in the polluted air; a main body having a dust collector receiving recess to which the dust collector is detachably provided; and a fixing device for fixing the dust collector on the main body and releasing the dust collector when the dust collector is separated.

In this case, the fixing device includes a switch provided at the main body and controlling the fixing state of the dust collector, and an elastic member incorporated integrally into the switch and restoring the switch to a fixing location of the dust collector.

The switch includes a push part projected frontward of the main body, and a hook incorporated integrally into the push part and projected to an upper surface of the dust collector.

The hook is selectively caught by a fixing groove provided on the upper surface of the dust collector. The dust collector comprises a top lid provided to be opened and closed.

The elastic member of the fixing device is extended from the upper surface of the switch to an upper part of the hook with an inclination of a predetermined degree, and having an upper end supported by a predetermined portion in the main body.

The fixing device further comprises a hinge lying at right angles to a length direction of the switch such that the switch is rotated in up and down direction. The hinge includes a rotation projection incorporated integrally into the switch and projected from each of both sides of the switch, and a supporting member for supporting the rotation projection.

The hinge includes a pivot passing through the switch, and a supporting groove provided at the main body for supporting the pivot.

The dust collector comprises an outlet for discharging clean air to a rear side thereof, the clean air separated from the impurities.

The main body comprises a clean air discharging conduit having an inlet formed on an inner wall of the dust collector receiving recess to be correspondent to the outlet of the dust collector.

The dust collector comprises a cleaner handle provided in front of the outer wall thereof.

Owing to the aforementioned present invention, the process of assembling the vacuum cleaner is simplified and the production cost needed for producing the vacuum cleaner is reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
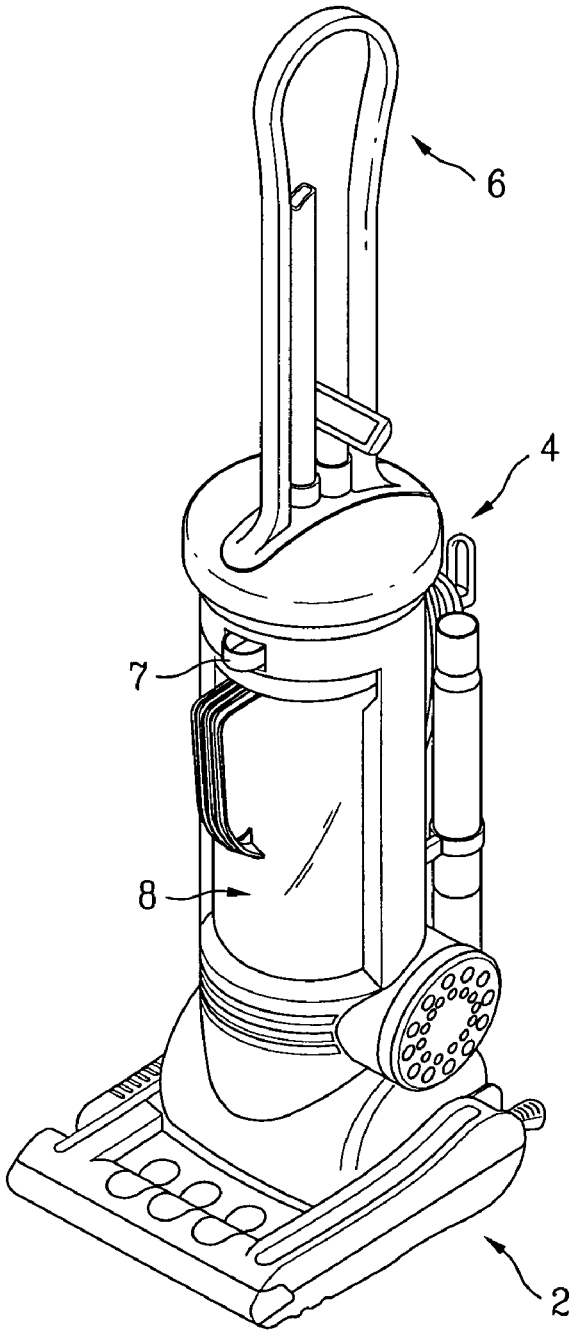
FIG. 1 Related Art
FIG. 1 illustrates a perspective view of a related art upright vacuum cleaner.
Figure 2:
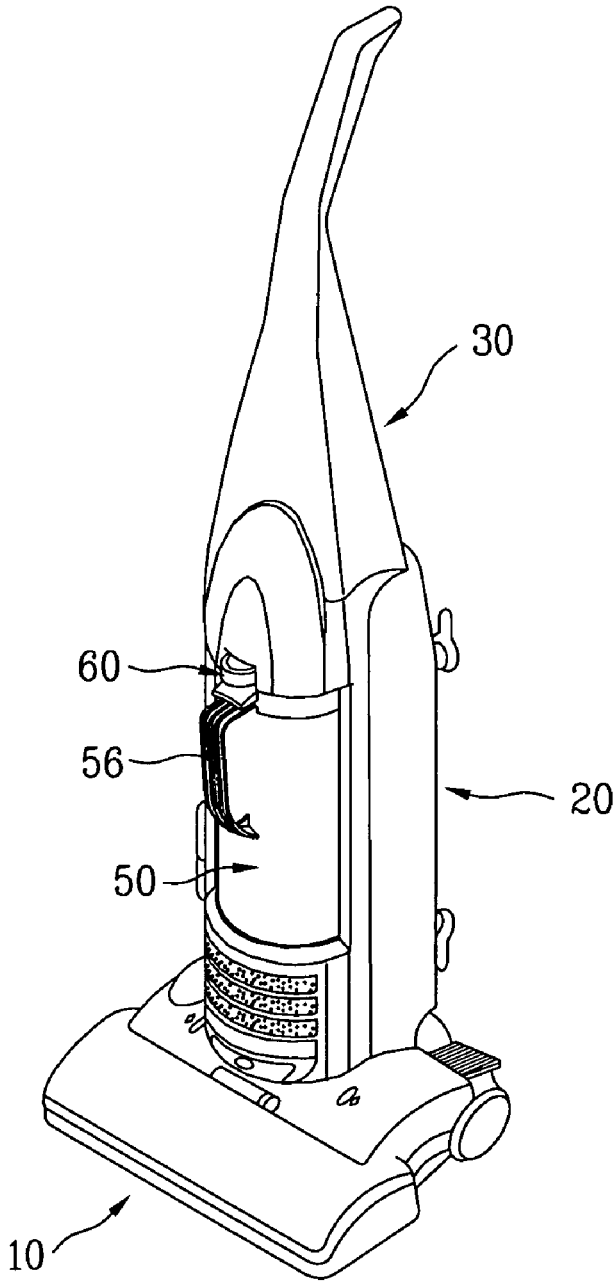
FIG. 2 illustrates a perspective view showing a vacuum cleaner in accordance with a preferred embodiment of the present invention.
Figure 3:
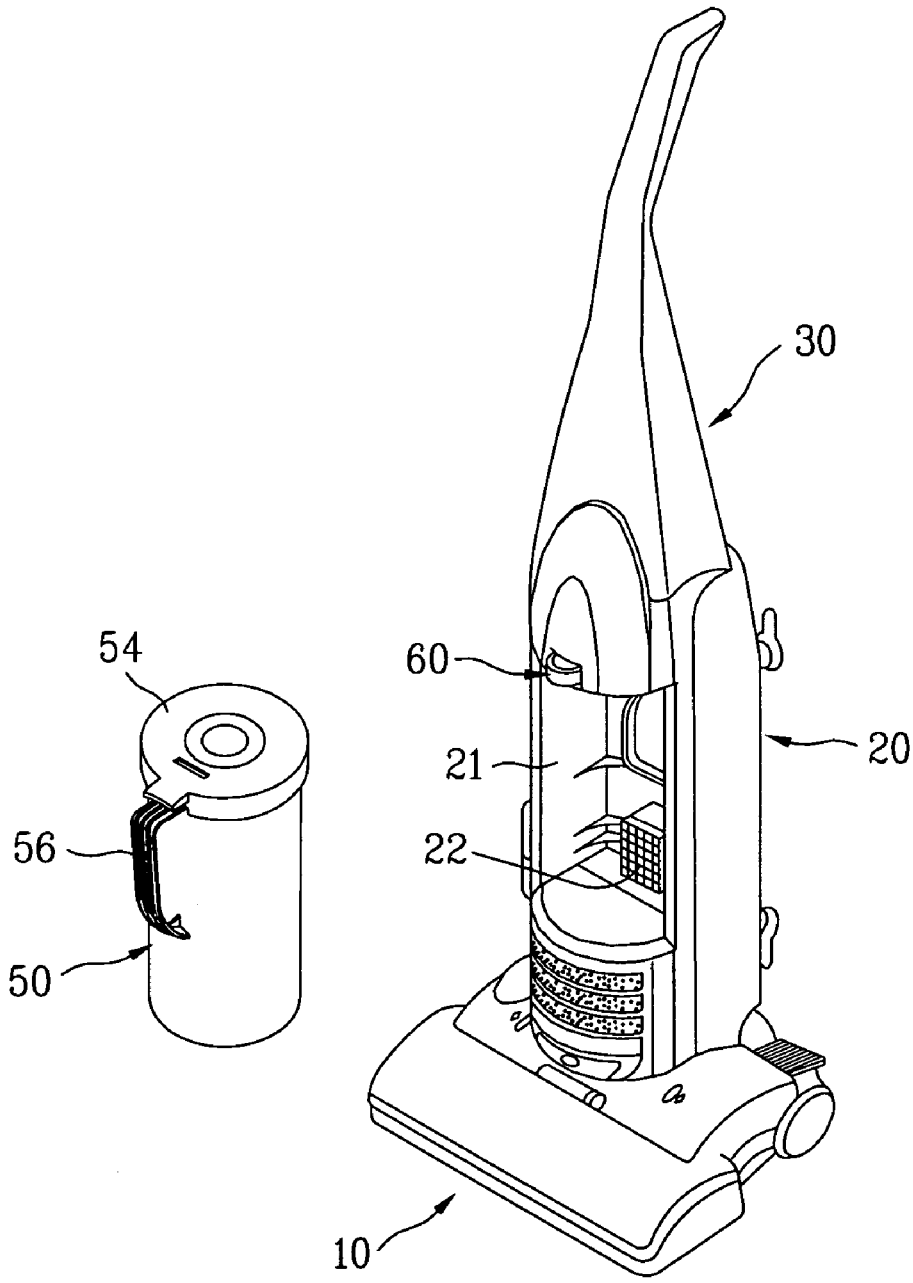
FIG. 3 illustrates a exploded perspective view showing a dust collector separated from a vacuum cleaner in accordance with a preferred embodiment of the present invention.
Figure 4:
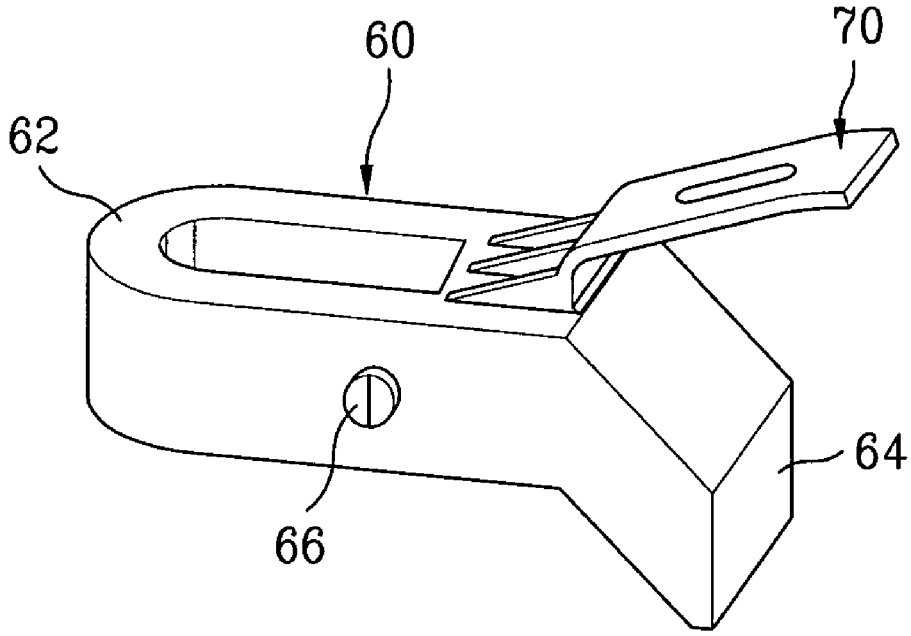
FIG. 4 illustrates a perspective view showing a switch of a fixing device in accordance with a preferred embodiment of the present invention.

Referring to FIGS. 2 and 3, a vacuum cleaner in accordance with a preferred embodiment of the present invention includes a head 10 moving along a floor and sucking in air containing impurities, a main body 20 coupled with the head, and a cleaner handle 30 coupled with the main body.

The head 10 includes wheels (not shown) at a lower part thereof, moves along the floor in a state of being close thereto, and sucks in polluted air containing impurities from outside through an inlet (not shown) provided at a lower part thereof.

It is desirable that an agitator is provided in the vicinity of the head 10. The agitator is to suck in the impurities better together with outside air by separating the impurities such as dust stuck on the floor. The agitator (not shown) includes a rotation axis horizontally provided in the inlet, and a brush provided on an outer circumferential surface of the rotation axis. It is desirable that the brush is provided in a spiral direction on the outer circumferential surface of the rotation axis.

The main body 20 is provided at an upper part of the head 10 to be rotatable in a predetermined range. In more detail, the main body 20 is hinge coupled with a rear top portion of the head 10.

Owing to the abovementioned structure, a user can clean the floor by holding the cleaner handle 30 and adjusting the angle of the main body 20 to a desired angle according to the height of the user or location to be cleaned.

An air suction device (not shown) such as a motor generating air sucking force is provided in the main body 20, and the polluted outside air is sucked in through the inlet of the head 10 by an operation of the air suction device. It is desirable that the air suction device is coupled with the agitator of the head 10 for rotating the rotation axis of the agitator together with generating the sucking force for sucking the polluted air. The main body 20 desirably includes a sensor, particularly a temperature sensor (not shown) for sensing an overload of the air suction device such as the motor.

In front of the main body 20, a dust collector receiving recess 21, to which a dust collector 50 is provided, is provided for collecting impurities separated from the polluted air.

Figure 5:
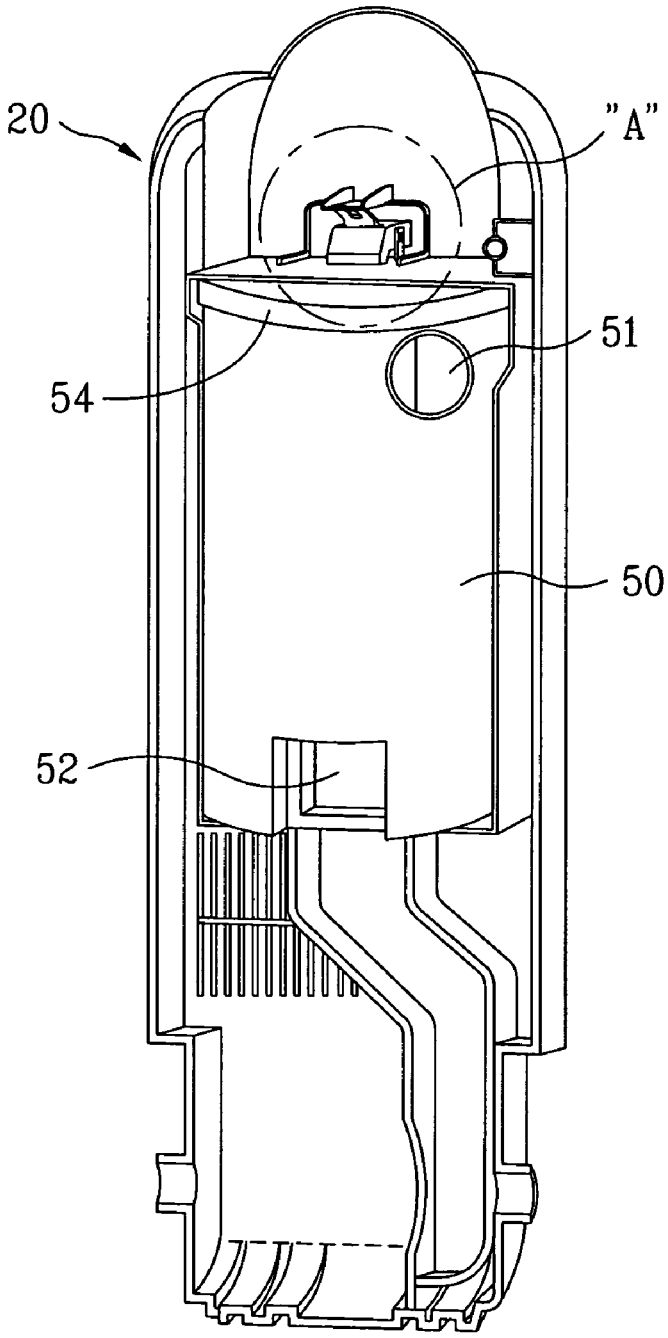
FIG. 5 illustrates a perspective view showing a fixing device provided in the preferred embodiment of a vacuum cleaner in accordance with the present invention is provided at a vacuum cleaner in accordance with a preferred embodiment of the present invention.
Figure 6:
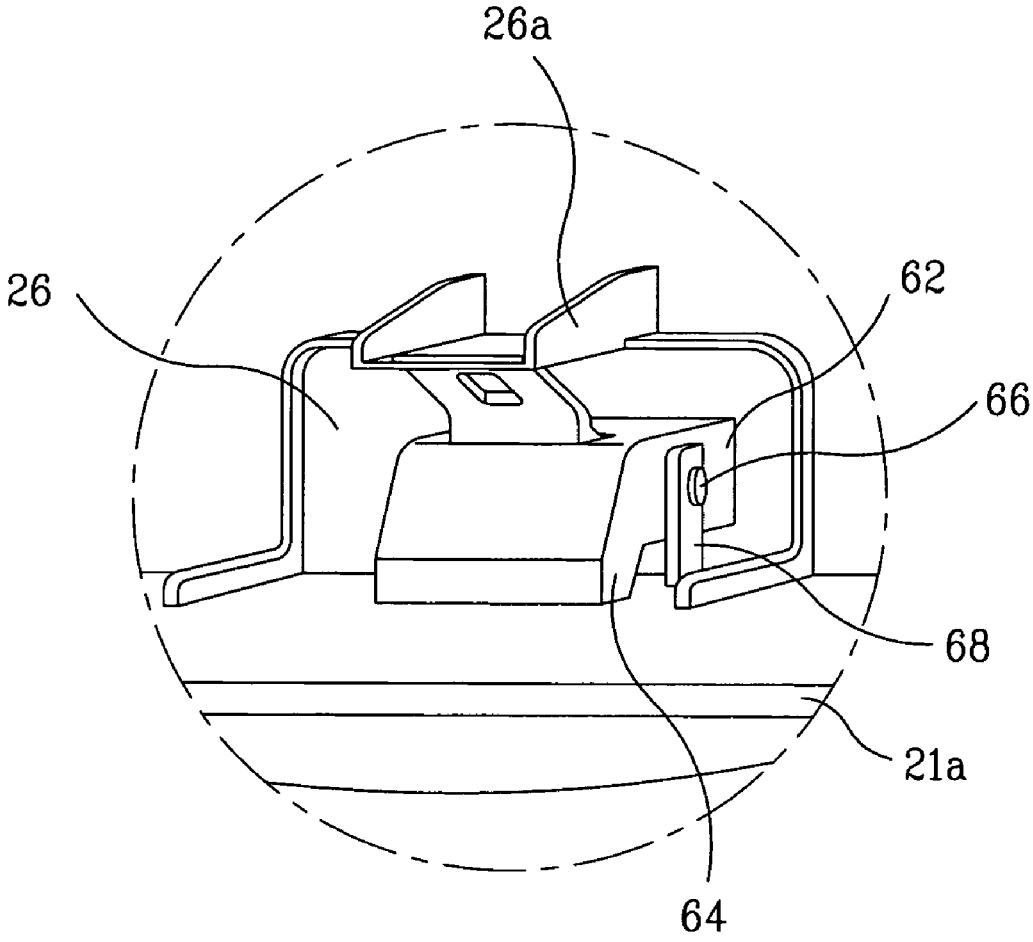
FIG. 6 illustrates a perspective view showing an exploded "A" section of FIG. 5.

Referring to FIGS. 3 and 5, the dust collector receiving recess 21 is provided on a front surface of the main body 20 for receiving the dust collector 20. The dust collector receiving recess 21 is depressed corresponding to be correspondent to an exterior of the dust collector 50.

Meanwhile, the dust collector 50 sucks in the polluted air through the inlet of the head 10, collects impurities by separating the impurities from the polluted air, and discharges cleaned air. The dust collector 50 collects the impurities by using a cyclone method or a method of filtering impurities by means of a filtering device. The cyclone method and the filtering method by means of the filtering device can of course be adopted at the same time as a method for separating impurities at the dust collector 50.*t,*

The dust collector 50 includes an inlet 51 and an outlet 52 provided respectively at predetermined locations on an outer wall of the dust collector for separating impurities from the polluted air, collecting impurities separated from the polluted air and discharging the cleaned air, and top lid 54 provided at an upper part of the dust collector for opening and closing the dust collector, and a dust collector handle 56 provided on a front outer wall of the dust collector.

In this case, it is desirable that the outlet 52 is configured to discharge the clean air to a rear side of the dust collector, and a clean air inlet 22 is provided corresponding to the outlet of the dust collector at the dust collector receiving recess 21 of the main body, so as to communicate the outlet with the clean air inlet 22.

A fan (not shown) is coupled to the air suction device such as the motor. The fan is provided on a clean air discharging conduit (not shown) having a first end coupled with the clean air inlet 22 and a second end coupled with the clean air discharger (not shown) discharging clean air to the outside, so as to force air flow.

The dust collector 50 is detachably provided at the main body 20 so as to be separated from the main body 20 and emptied when the impurities such as dust are piled up more than a predetermined amount in the dust collector 50. For that reason, the vacuum cleaner in accordance with the present invention includes a fixing device 60 for fixing/releasing the dust collector 50 on/from the main body 20 when the dust collector 20 is separated.

Referring to FIGS. 3 to 6, a fixing groove 54*a* having a predetermined depth is provided on an upper surface of the top lid 54 provided at the upper part of the dust collector, to be correspondent to the fixing device 60. The fixing device includes a switch 60 for selectively fixing the dust collector 50, and an elastic member 70 for restoring the switch to the fixing groove 54*a* of the dust collector.

The switch 60 is inserted into the main body 20 particularly into the switch installer 26 provided at an upper part of the dust collector receiving recess 21, and has a first end projected to a front side of the main body 20 and a second end projected to the fixing groove 54*a* provided at the top lid 54, so as to be formed in a "¬" form as a whole.

In this case, the switch 60 includes a push part 62 projected to the front side of the main body to be exposed, and a hook 64 projected downward to be caught by the fixing groove 54*a*.

The elastic member 70 and the switch 60 are formed as a single body. In more detail, the elastic member 70 has a first end coupled with the upper surface of the switch 60 and a second end extended to the upper part of the hook with an inclination of a predetermined degree. An upper end of the elastic member 70 is supported by a supporting member 26*a* of the elastic member 70, the supporting member 26*a* provided at an upper part of the switch installer 26 provided on the main body 20, such that the elastic member 70 elastically supports the switch 60.

Although the supporting member of the elastic member can be variously structured, the supporting member 26*a* of the elastic member in accordance with the present invention includes a slit into which an upper end of the elastic member is inserted and fixed.

The switch 60 and the elastic member 70 in the present invention may be fabricated by an injection molding because the elastic member 70 made of synthetic resins has enough elasticity.

Meanwhile, in accordance with the present invention, the switch 60 rotates in up and down direction about a rotation axis lying at right angles to a length direction thereof, so as to fix or release the dust collector 50.

For that reason, the switch 60 includes a hinge. In this case, the hinge includes a rotation projection 66 projected in a lateral direction from both sides of the switch 60 to form a rotation center, and a supporting member 68 having a hole rotatably supporting the rotation projection.

The hinge may include a pivot passing through the switch in right and left directions, and a supporting groove for supporting both ends of the pivot.

FIG. 5 illustrates a perspective view showing the fixing device provided at the switch installer 26. Referring to FIG. 5, the rotation projection 66 projected from both sides of the switch 60 is rotatably coupled with the supporting member 68 to be supported, the supporting member 68 formed to be integrated with the main body 20.

The hook 64 passed through the upper surface 21*a* of the dust collector receiving recess 21 of the main body 20, and projected downward is elastically supported by the elastic member 70 and caught by the fixing groove 54*a* provided at the top lid 54, such that the dust collector 50 is fixed into the dust collector receiving recess 21 on the main body.

When the vacuum cleaner having the dust collector 50 fixed on the main body 20 is operated, the impurities sucked in together with outside air through the inlet of the head 10 is piled in the dust collector 50.

For this reason, the elastic member 70 extended upward from a middle part of the switch 60 has an upper end supported by the slit formed at the supporting member 26*a* of the elastic member provided at the upper part of the switch installer 26, so as to be prevented from slipping or moving.

Next, a process of detaching the dust collector by the fixing device structured as aforementioned will be described.

First, the dust collector 50 is provided at the main body 20 when the dust collector 50 is pushed into the dust collector receiving recess 21 on the main body in a front to rear direction.

When a rear outer wall of the dust collector 50 is closely adhered to a rear inner wall of the dust collector receiving recess 21, the hook 64 of the switch 60 is moved downward by the elastic member 70, and caught by the fixing groove 54*a* formed on the top lid 54, such that the dust collector 50 is fixed on the main body 20.

When the vacuum cleaner with the dust collector is operated, cleaning is performed in the steps of sucking in polluted outside air through the inlet of the head via an operation of the air suction device, and discharging the cleaned air to the outside through the main body, the cleaned air separated from the impurities such as dust at the dust collector.

Next, if the impurities such as dust are piled up more than a predetermined amount in the dust collector 50 after operating the vacuum cleaner for a predetermined time, the dust collector 50 needs to be separated from the main body 20 so as to be emptied.

For this reason, when the user presses down the upper surface of the push part 62 projected frontward of the main body, the hook 64 of the switching member is spun up about the rotation axis 66 of the hinge, and freed from the fixing groove 54*a*, thereby releasing the fixed dust collector 50. In this instance, the user can hold the dust collector handle 56 provided in front of the dust collector 50, and separate the dust collector from the main body 20.

Although the fixing device for the dust collector, the fixing device provided in the preferred embodiment of the present invention is assembled at the upper part of the dust collector receiving recess 21, the fixing device for the dust collector may be provided at a lower part thereof. When the fixing device is provided at the lower part of the dust collector receiving recess, it is natural that the hinge including the switch is projected upward, the elastic member is extended downward with an inclination of a predetermined degree for supporting an upper part of the hinge, and the fixing groove is provided on a lower surface of the dust collector.

Although the upright type vacuum cleaner having a main body coupled with the upper part of the head is mainly discussed in the preferred embodiment of the present invention, the structure is not limited to the present invention, but can be applied to a canister type vacuum cleaner having a separate head and main body.

The effect of the vacuum cleaner is summarized as follows. First, according to the vacuum cleaner in accordance with the present invention, the dust collector separately collecting impurities such as dust is fixed on the main body, or the fixing device for releasing the fixed state of the dust collector is provided. Therefore, it is easy to detach the dust collector, and the dust collector is not separated from the dust collector during cleaning.

Second, according to the vacuum cleaner of the present invention, the number for configuring the fixing device is decreased. Accordingly, a process of assembling the vacuum cleaner is simplified, and production cost is reduced.

Third, according to the vacuum cleaner of the present invention, it is easy to maintain and repair the fixing device because the switching member and the elastic member are formed as a single body.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A vacuum cleaner, comprising:

a head including an inlet for sucking in polluted air containing impurities from outside by an operation of an air suction device generating air suction force;

a dust collector for collecting impurities contained in the polluted air;

a main body having a dust collector receiving recess to which the dust collector is detachably provided; and a fixing device for fixing the dust collector on the main body and releasing the dust collector when the dust collector is separated, wherein the fixing device includes a switch mounted on the main body and controlling the fixing state of the dust collector; wherein the switch comprises:

a push part that projects from a front surface of the main body;

a hook that is integral with the push part and that projects towards an upper surface of the dust collector; and an elastic member that is also integral with the push part, wherein the elastic member extends upward from the push part such that a distal end of the elastic member is spaced apart from the hook, and wherein the elastic member biases the hook towards a fixing position, wherein the main body further comprises a supporting slit that receives the distal end of the elastic member.

2. The vacuum cleaner as claimed in claim 1, wherein the hook is selectively caught by a fixing groove provided on the upper surface of the dust coliector.

3. The vacuum cleaner as claimed in claim 1, wherein the dust collector comprises a top lid provided to be opened and closed.

4. The vacuum cleaner as claimed in claim 1, wherein the elastic member of the switch extends upward at an angle from an upper surface of the push part to a position located over the hook, and wherein the distal end of the elastic member is supported by a supporting member on the main body.

5. The vacuum cleaner as claimed in claim 1, wherein the switch is rotatably mounted on the main body.

6. The vacuum cleaner as claimed in claim 5, wherein the fixing device further comprises:

first and second rotation projections that project from opposite sides of the switch; and first and second projection receiving holes mounted on the main body which receive and support the first and second rotation projections, respectively.

7. The vacuum cleaner as claimed in claim 5, wherein a pivot pin passes through the switch and wherein ends of the pivot pin are mounted in receiving holes on the main body for supporting the pivot pin.

8. The vacuum cleaner as claimed in claim 1, wherein the dust collector comprises an outlet for discharging clean air to a rear side thereof.

9. The vacuum cleaner as claimed in claim 8, wherein the main body comprises a clean air discharging conduit having an inlet formed on an inner wall of the dust collector receiving recess to be correspondent to the outlet of the dust collector.

10. The vacuum cleaner as claimed in claim 9, wherein the air suction device comprises a fan provided at the clean air discharging conduit.

11. The vacuum cleaner as claimed in claim 1, wherein the dust collector comprises a dust collector handle provided in front of the outer wall thereof.

12. A vacuum cleaner, comprising:

a head including an inlet for sucking in polluted air containing impurities from outside by an operation of an air suction device generating air suction force;

a dust collector for collecting impurities contained in the polluted air, and having a fixing groove on an upper surface thereof;

a main body coupled with the head, the main body having a dust collector receiving recess, and having an air suction device therein;

a cleaner handle coupled with the main body; and a fixing device for fixing the dust collector on the main body and releasing the dust collector when the dust collector is separated, wherein the fixing device comprises:

a switch mounted on the main body, the switch including a first end projected outside the main body and a second end having a hook that is caught by the fixing groove of the dust collector for selectively fixing the dust collector on the main body, and an elastic member incorporated integrally into an upper surface of the switch, wherein the elastic member extends upward from the switch to a position located over the hook, and wherein the elastic member biases the hook into the fixing groove, wherein the main body further comprises a supporting slit that receives a distal end of the elastic member.

13. The vacuum cleaner as claimed in claim 12, wherein the dust collector comprises a top lid provided to be opened and closed at an upper part thereof.

14. The vacuum cleaner as claimed in claim 12, wherein the elastic member of the fixing device extends upward from an upper surface of the switch at a predetermined angle with respect to the upper surface of the switch.

15. The vacuum cleaner as claimed in claim 12, wherein the fixing device is rotatably mounted on the main body such that a front end of the switch can be rotated up and down.

16. A vacuum cleaner, comprising:

a head including an inlet for sucking in polluted air containing impurities from outside by an operation of a motor generating air suction force, and having an agitator moved by the operation of the motor;

a dust collector for collecting impurities contained in the polluted air, and including a top lid provided to be opened and closed, wherein the top lid has a fixing groove on an upper surface thereof;

a main body coupled with the head, having a motor therein, and having a dust collector receiving recess; and a fixing device for fixing the dust collector on the main body and releasing the dust collector when the dust collector is separated, wherein the fixing device comprises:

a switch mounted on the main body, the switch having a first end that projects outside the main body, and a second end having a hook that projects into the fixing groove of the top lid of the dust collector to fix the dust collector on the main body, an elastic member incorporated integrally into an upper surface of the switch, wherein the elastic member biases the hook into the fixing groove; and a hinge that rotationally couples the switch to the main body, wherein the main body further comprises a supporting slit that receives a distal end of the elastic member.

17. The vacuum cleaner as claimed in claim 16, wherein the elastic member of the switch is extended from the upper surface of the switch at an angle so that the distal end of the elastic member is located over the hook.

18. The vacuum cleaner as claimed in claim 17, wherein the hinge comprises:

first and second rotation projections that extend from opposite sides of the switch; and a supporting member mounted on the main body that supports the first and second rotation projections.

19. The vacuum cleaner of claim 16, wherein the distal end of the elastic member is spaced apart from the hook.

* * * * *